US005118358A

United States Patent [19]

van Brunt et al.

[11] Patent Number: 5,118,358

[45] Date of Patent: Jun. 2, 1992

[54] DEGREASING AGENT

[75] Inventors: Vincent van Brunt; Eugene C. McCall, Greenville; John R. Johnson, Columbia, all of S.C.

[73] Assignee: University of South Carolina and the city of Columbia, South Carolina, Columbia, S.C.

[21] Appl. No.: 508,237

[22] Filed: Apr. 11, 1990

[51] Int. Cl.[5] ..... B08B 3/02; B08B 3/08; C23G 5/00; B01F 1/00

[52] U.S. Cl. ..... 134/40; 134/22.12; 134/22.14; 134/22.15; 134/30; 252/167; 252/170; 252/364

[58] Field of Search ..... 134/22.12, 22.14, 22.15, 134/30, 40; 252/170, 364, 167

[56] References Cited

U.S. PATENT DOCUMENTS

| | | | |
|---|---|---|---|
| 985,405 | 2/1911 | Ellis | 252/167 |
| 2,168,024 | 8/1939 | Ensminger | 252/364 |
| 2,613,186 | 10/1952 | Pickett et al. | 252/170 |
| 3,553,146 | 1/1971 | Butke | 252/364 |

*Primary Examiner*—Theodore Morris
*Assistant Examiner*—Zeinab El-Arini
*Attorney, Agent, or Firm*—Brumbaugh, Graves, Donohue & Raymond

[57] ABSTRACT

It has now been found that a mixture of methyl acetate, methyl ethyl ketone and mineral spirits along with a surfactant effectively dissolves fats and greases, and is especially useful for unclogging sewer lines.

16 Claims, No Drawings

DEGREASING AGENT

This invention relates to a novel degreasing agent that neutralizes and dissolves fat compounds. It is especially useful in industrial applications, particularly in unclogging hard grease that blocks sewer lines.

BACKGROUND

Sewer lines and waste treatment equipment frequently are subject to clogging by grease build up, especially in urban areas having a large number of restaurants.

Traditionally, sewer grease has been cleared using one of several methods. Grease interceptors have been employed to prevent grease from entering the sewer system in the first place; however they require proper installation and maintenance to be effective. Dawson et al., "Design and Operation of Grease Interceptors", J. Water Pollut. Control Fed., 16: 482 (1944).

Caustic chemicals, such as sodium hydroxide and emulsifiable chlorobenzene compounds have also been used over the years to prevent grease accumulation in sewers, however they have not been wholly successful. Lee, "How to Degrease Sludge Lines", Wastes Engineering, 30: 204 (1959). More recently, many other compounds have become commercially available for this purpose. In particular, a methylene chloride/mineral spirits mixture containing about 6% by weight methylene chloride, commercially available from Thero-Chem as T160, has been found to be a useful degreaser. Although, methylene chloride is a powerful degreaser, it is a known carcinogen, thereby limiting the usefulness of T160. In addition, T160 also damages pumping equipment, particularly pump seals, made of plastic, neoprene rubber, or butyl rubber. Such pump seals are used in the water trucks used to transport and spray cleaning agents into sewer equipment.

Manual removal of grease build up using rods and high pressure water hoses is also used. High pressure water streams may break up grease clogs and is certainly a non-toxic method of grease control; however water alone does not dissolve grease.

SUMMARY OF THE INVENTION

It has now been found that a mixture of methyl acetate, methyl ethyl ketone and mineral spirits along with a surfactant effectively dissolves fats and greases, and is especially useful for unclogging sewer equipment and lines.

DETAILED DESCRIPTION OF THE INVENTION

The degreasing agent of applicants' invention comprises a combination of methyl acetate, methyl ethyl ketone (MEK) and a surfactant in mineral spirits (petroleum fractions). This degreasing agent readily dissolves fats and greases, and may be used in conjunction with a high pressure stream of water to break up and dissolve grease in sewers. The degreasing agent does not comprise any known carcinogenic compounds. Each component is biodegradable and additionally does not harm sewer lines or waste treatment equipment, including pump seals (particularly those made of neoprene and butyl rubber) and other equipment commonly used for storage and distribution of degreasing chemicals.

Preferably, the degreasing agent of applicants' invention comprises a mixture of 2 to 20% by weight methyl acetate plus MEK and 80 to 98% by weight mineral spirits. To this mixture is added a surfactant, the surfactant making up about 5 to 20%, preferably 10%, by volume of the degreasing agent composition.

The amount of methyl acetate in the methyl acetate/MEK/mineral spirits mixture is preferably 2 to 20% by weight. The amount of MEK in the methyl acetate/MEK/mineral spirits mixture is preferably 2 to 20% by weight. The total amount of methyl acetate and MEK, however is preferably 20% by weight of total methyl acetate/MEK/mineral spirits mixture. If the amount of methyl acetate is increased or decreased, the amount of MEK may be decreased or increased, respectively. If the amount of MEK is increased or decreased, the amount of methyl acetate may be decreased or increased, respectively. In a preferred embodiment, the MEK/methyl acetate/mineral spirits mixture comprises 6% by weight MEK, 14% by weight methyl acetate and 80% by weight mineral spirits.

A surfactant is added to the methyl acetate/MEK/mineral spirits mixture to form applicants' degreasing agent. Surfactants that may be used preferably have a hydrophobic lipophilic balance (HLB) of greater than 12. Generally, the higher the HLB value, the greater the tendency of an emulsifier to be soluble in water. A pure hydrophilic emulsifier has an HLB of 20. See, Griffin, J. Soc. Cosmet. Chem., 1: 311 (1949) and J. Soc. Cosmet. Chem., 5 : 4 (1954). Examples of appropriate surfactants for use in the invention include Igepal ®600, a nonylphenoxy polyethylene oxide, from GAF corporation and Syn Lube 6277-A an alkoxylated fatty acid from Milliken Chemical Co. The surfactant preferably comprises 5–20% by volume, more preferably 10% by volume, of the degreasing agent.

The degreasing agent is prepared by combining the methyl acetate, MEK and mineral spirits to form a mixture. Next, the surfactant is added to the methyl acetate/MEK/mineral spirits mixture to form the degreasing agent. The methyl acetate, MEK and mineral spirits may be combined in any order; however, the surfactant should be added last. The degreasing agent may be combined with a high pressure water stream and sprayed into sewer lines. Applicants' degreasing agent then neutralizes and dissolves fat and hard grease in the sewer lines, thereby unclogging the lines.

The following non-limiting examples further illustrate applicants' invention.

EXAMPLE 1

Thirteen compounds were tested for their ability to dissolve Crisco ®, an edible vegetable shortening manufactured by The Proctor & Gamble Co. Specifically, their dissolving strengths were compared with that of methylene chloride.

Preweighed Crisco ® balls were added to 50 ml beakers each containing undiluted samples of one of the thirteen compounds tested. The beakers were allowed to sit for twenty minutes. The Crisco ® balls were removed, dried under a vented hood for twenty-four hours and weighed again.

The percentages by weight of Crisco ® dissolved by each of the compounds tested are shown in Table I. Those compounds which dissolved zero percent either were not effective at dissolving Crisco ® or did not evaporate from the Crisco ® balls within 24 hours, and actually added weight to the Crisco ® balls.

TABLE I

| PURE CHEMICAL ANALYSIS | |
|---|---|
| COMPOUND | % CRISCO ® DISSOLVED |
| MIBK* | 24 |
| SYN LUBE* | 0 |
| MEK* | 28 |
| METHYL ACETATE* | 21 |
| ACETALDEHYDE* | 38 |
| CYCLOHEXANONE** | 5 |
| PROPIANALDEHYDE** | 13 |
| GLYOXAL** | 4 |
| MORPHOLINE** | 6 |
| ETHYLENE GLYCOL** | 0 |
| DIETHYLENE GLYCOL** | 0 |
| CARBON DISULFIDE** | 89 |
| CYCLOHEXANE** | 36 |
| METHYLENE CHLORIDE** | 80 |

*1 gram balls of Crisco ®
**3 gram balls of Crisco ®

Good results were achieved with those compounds dissolving 20% or more of the 1 gram Crisco ® balls or 50% or more of the 3 gram Crisco ® balls.

EXAMPLE 2

Samples of MIBK, MEK, methyl acetate, carbon disulfide and methylene chloride were diluted with mineral spirits to concentration of 6% by weight. 200 ml of each diluted compound in mineral spirits were placed into separate 400 ml beakers on top of a magnetic stirring plate. Preweighed balls of either Crisco ® or lard were added to the beakers and stirred for 10 minutes at 100 rpm. The balls were removed, dried under a vented hood for 24 hours and then weighed again.

Table IIa shows the maximum percentages by weight of Crisco ® and lard dissolved by each of the 6% solutions for a series of samples. Table IIb shows the average percentages by weight of Crisco ® and lard dissolved by each of the 6% solutions for a series of samples.

TABLE IIa

| DILUTED CHEMICAL ANALYSIS (MAXIMUM VALUES) (6% IN MINERAL SPIRITS) | | |
|---|---|---|
| COMPOUND | % CRISCO ® DISSOLVED | % LARD DISSOLVED |
| METHYLENE CHLORIDE | 43 | 51 |
| CARBON DISULFIDE | 40 | 28 |
| METHYL ACETATE | 41 | 39 |
| MIBK | 46 | 37 |
| MEK | 33 | 36 |
| MINERAL SPIRITS | 31 | 31 |

TABLE IIb

| DILUTED CHEMICAL ANALYSIS (AVERAGE VALUES) (6% IN MINERAL SPIRITS) | | |
|---|---|---|
| COMPOUND | % CRISCO ® DISSOLVED | % LARD DISSOLVED |
| METHYLENE CHLORIDE | 46 | 54 |
| CARBON DISULFIDE | 44 | 36 |
| METHYL ACETATE | 57 | 64 |
| MIBK | 45 | 56 |
| MEK | 38 | 58 |
| MINERAL SPIRITS | 37 | 37 |

In Examples 1 and 2, methyl acetate and MEK showed excellent grease dissolving strength. The percentages of Crisco ® and lard dissolved by methyl acetate and MEK were comparable to those of methylene chloride and the other effective grease dissolving compounds. Methyl acetate and MEK are advantageous over the other compounds tested in that they are not carcinogenic. In addition, methyl acetate and MEK are biodegradable and not corrosive to plastic or metal products, and therefore are not harmful to sewer cleaning equipment.

EXAMPLE 3

The same procedure as in Example 2 was followed using samples of methyl acetate and MEK in mineral spirits, in which the concentration of methyl acetate and MEK was 20% by weight in each of the samples. The amounts by weight of Crisco ® and lard dissolved are shown in Table III.

TABLE III

| DILUTED CHEMICAL ANALYSIS (20% IN MINERAL SPIRITS) | | |
|---|---|---|
| COMPOUND | % CRISCO ® DISSOLVED | % LARD DISSOLVED |
| METHYL ACETATE | 48 | 39 |
| MEK | 30 | 55 |

These results show that 20 weight % solutions of both methyl acetate and MEK in mineral spirits exhibit excellent grease dissolving characteristics.

EXAMPLE 4

Various mixtures of methyl acetate, MEK and mineral spirits were tested for their grease dissolving power. Specifically, the procedure of Example 2 was followed using mixtures of methyl acetate and MEK in mineral spirits. Solutions of 6% by weight MEK with 14% by weight methyl acetate in mineral spirits, 6% by weight MEK with 10% by weight methyl acetate in mineral spirits and 8% by weight MEK with 10% by weight methyl acetate in mineral spirits were used to dissolve balls of Crisco ® and lard.

The maximum and average percentages by weight of Crisco ® and lard dissolved are given in Tables IVa and IVb, respectively.

TABLE IVa

| MIXTURE ANALYSIS (MAXIMUM VALUES) | | | |
|---|---|---|---|
| | Ratio of % MEK/% Methyl acetate | | |
| | 6/14 | 6/10 | 8/10 |
| % Crisco ® dissolved | 61 | 62 | 44 |
| % lard dissolved | 50 | 45 | 40 |

TABLE IVb

| MIXTURE ANALYSIS (AVERAGE VALUES) | | | |
|---|---|---|---|
| | Ratio of % MEK/% Methyl acetate | | |
| | 6/14 | 6/10 | 8/10 |
| % Crisco ® dissolved | 51 | 62 | 44 |
| % lard dissolved | 39 | 46 | 40 |

The mixture of 6% by weight MEK and 14% by weight methyl acetate in mineral spirits showed the best overall dissolving strength for both Crisco ® and lard.

Applicants' degreasing agent demonstrates excellent grease dissolving capabilities comparable to methylene chloride, and at the same time, contains no known carcinogens. It may be effectively used to unclog sewer lines and equipment without damage to plastic, rubber, or metal equipment.

We claim:

1. A degreasing agent comprising a mixture of methyl acetate, methyl ethyl ketone and mineral spirits along with a surfactant.

2. The degreasing agent according to claim 1, wherein the surfactant has an HLB of greater than 12.

3. The degreasing agent according to claim 1, wherein the surfactant is an emulsifier selected from the group consisting of a nonylphenoxy polyethylene oxide and an alkoxylated fatty acid.

4. The degreasing agent according to claim 1, wherein the mixture of methyl acetate, methyl ethyl ketone and mineral spirits comprises 2 to 20% by weight methyl acetate plus methyl ethyl ketone and 80 to 98% by weight mineral spirits.

5. The degreasing agent according to claim 1, wherein the mixture of methyl acetate, methyl ethyl ketone and mineral spirits contains 2 to 20% by weight methyl acetate.

6. The degreasing agent according to claim 1, wherein the mixture of methyl acetate, methyl ethyl ketone and mineral spirits contains 2 to 20% by weight methyl ethyl ketone.

7. The degreasing agent according to claim 1, wherein the mixture of methyl acetate, methyl ethyl ketone and mineral spirits comprises 6% by weight methyl ethyl ketone, 14% by weight methyl acetate and 80% by weight mineral spirits.

8. The degreasing agent according to claim 1 containing 5-20% by volume of surfactant.

9. A method for dissolving grease, which comprises:

mixing methyl acetate, methyl ethyl ketone and mineral spirits;

combining the methyl acetate/methyl ethyl ketone/-mineral spirits mixture with a surfactant to form a degreasing agent;

introducing the degreasing agent into a high pressure stream of water; and applying the high pressure stream containing the degreasing agent and water to the grease.

10. The method according to claim 9, wherein the methyl acetate/methyl ethyl ketone/mineral spirits mixture comprises 2 to 20% by weight methyl acetate.

11. The method according to claim 9, wherein the methyl acetate/methyl ethyl ketone/mineral spirits mixture comprises 2 to 20% by weight methyl ethyl ketone.

12. The method according to claim 9, wherein the surfactant comprises 5-20% by volume of the degreasing agent.

13. The method according to claim 9, wherein the surfactant has an HLB of greater than 12.

14. The method according to claim 9, wherein the surfactant is an emulsifier selected from the group consisting of a nonylphenoxy polyethylene oxide and an alkoxylated fatty acid.

15. The method according to claim 9, wherein the mixture of methyl acetate, methyl ethyl ketone and mineral spirits comprises 2 to 20% by weight methyl acetate plus methyl ethyl ketone and 80 to 98% by weight mineral spirits.

16. The method according to claim 9, wherein the mixture of methyl acetate, methyl ethyl ketone and mineral spirits comprises 6% by weight methyl ethyl ketone, 14% by weight methyl acetate and 80% by weight mineral spirits.

* * * * *

UNITED STATES PATENT AND TRADEMARK OFFICE

CERTIFICATE OF CORRECTION

PATENT NO. : 5,118,358

DATED : June 2, 1992

INVENTOR(S) : Vincent van Brunt, et. al.

It is certified that error appears in the above-indentified patent and that said Letters Patent is hereby corrected as shown below:

Title page, item [75], after "van Brunt", insert --, Columbia--;
after "McCall", inert --, Jr.--;
Column 2, line 31, delete "600" and substitute --660-- therefor.

Signed and Sealed this

Twenty-second Day of February, 1994

*Attest:*

BRUCE LEHMAN

*Attesting Officer*

*Commissioner of Patents and Trademarks*